US006696400B2

(12) United States Patent
Puelle Andrade et al.

(10) Patent No.: US 6,696,400 B2
(45) Date of Patent: Feb. 24, 2004

(54) PHOTOBLEACH SPECKLE AND LAUNDRY DETERGENT COMPOSITIONS CONTAINING IT

(75) Inventors: Paulo Cesar Puelle Andrade, Sao Paulo (BR); Juan Jose Bonelli, Buenos Aires (AR); Marcio Henrique Perissinotto Bonfa, Sao Paulo (BR); Paulo-Enrique De Gusmao, Sao Paulo (BR)

(73) Assignee: Unilever Home & Personal Care USA, division of Conopco, Inc., Greenwhich, CT (US)

( * ) Notice: Subject to any disclaimer, the term of this patent is extended or adjusted under 35 U.S.C. 154(b) by 0 days.

(21) Appl. No.: 10/223,565

(22) Filed: Aug. 19, 2002

(65) Prior Publication Data

US 2003/0087790 A1 May 8, 2003

(30) Foreign Application Priority Data

Aug. 20, 2001 (GB) ..... 0120160
Jul. 12, 2002 (GB) ..... 0216095

(51) Int. Cl.[7] ..... C11D 3/00
(52) U.S. Cl. ..... 510/301
(58) Field of Search ..... 510/301, 302

(56) References Cited

U.S. PATENT DOCUMENTS

| | | | | |
|---|---|---|---|---|
| 3,931,037 A | | 1/1976 | Hall | 252/135 |
| 4,721,633 A | | 1/1988 | Baldassin | 427/212 |
| 4,762,636 A | | 8/1988 | Balliello et al. | 252/95 |
| 5,605,883 A | | 2/1997 | Iliff et al. | 510/444 |
| 6,369,020 B1 | * | 4/2002 | Kohlus et al. | 510/438 |

FOREIGN PATENT DOCUMENTS

| | | |
|---|---|---|
| DE | 3430773 | 3/1985 |
| EP | 057 088 | 8/1982 |
| EP | 119 746 | 9/1984 |
| GB | 2 199 338 | 7/1988 |
| WO | 98/16615 | 4/1998 |
| WO | 99/51714 | 10/1999 |
| WO | 01/77274 | 10/2001 |
| WO | 02/10327 | 2/2002 |

OTHER PUBLICATIONS

GB Search Report in a GB application GB 0120160.7.
Derwent Abstract of DE 34430773—published Mar. 14, 1985.
Co–pending Application: Applicant: Bonelli et al., S/N: 10/223,566; Filed: Aug. 19, 2002.
PCT International Search Report in a PCT application: PCT/EP 02/09114.

* cited by examiner

*Primary Examiner*—Yogendra N. Gupta
*Assistant Examiner*—John M Petruncio
(74) *Attorney, Agent, or Firm*—Rimma Mitelman

(57) ABSTRACT

A speckle composition for use in particulate laundry detergent compositions comprising a porous granular carrier, and at least 0.01 wt % photobleach, preferably at least 0.05 wt %, more preferably at least 0.1 wt %, based on the active ingredient the composition being layered with a finely divided high carrying capacity particulate material and/or a water-soluble material. The most preferred photobleach is a blend of Zn and Al sulphonated phthalocyanine.

25 Claims, No Drawings

PHOTOBLEACH SPECKLE AND LAUNDRY DETERGENT COMPOSITIONS CONTAINING IT

TECHNICAL FIELD

The present invention relates to a granular composition for use as speckles in a particulate laundry detergent composition comprising photobleach.

BACKGROUND AND PRIOR ART

Photobleaches are often added to detergent laundry powders to provide bleaching of the washed fabrics to improve their visual appeal. The most common and simplest way of incorporating them into detergent powders is to add them to the slurry prior to spray drying of the base powder. However some of the photobleach may be lost due to degradation and evaporation in the spray drying process. Furthermore, there is a well-known problem of staining of the washed fabric due to the photobleach.

EP 119 746A (Unilever) discloses spraying a solution or suspension of a Zn or Al phthalocyanine sulphonate photobleach onto a detergent base powder subsequent to the spray drying process.

WO 99 51714A (Unilever) discloses a coloured photobleach speckle composition giving reduced staining wherein the carrier is an α-hydroxy organic acid, preferably citric acid, with a water-soluble barrier material and a flow aid e.g. silica. The composition is claimed to provide reduced fabric staining.

DE 3 430 773A (Ciba Geigy) discloses a washing powder additive in speckle form which contains a photobleach, an inorganic carbonate and an acid. Effervescence action generated by the reaction between the carbonate and the acid is claimed to keep the speckles at the surface of the wash liquor and reduce staining of the washed fabrics.

U.S. Pat. No. 3,931,037 (Procter & Gamble) discloses a colourless granular composition comprising a pale-coloured photobleach granule made by the dry-mixing of a phthalocyanine photobleach particle and a granular material (e.g. sodium tripolyphosphate or spray-dried detergent base powder) to which a liquid (e.g. water) is added.

U.S. Pat. No. 4,762,636 (Ciba-Geigy) discloses a process for making floating speckles and preferably comprise an active substance such as a phthalocyanine. The bulk density of the speckles is in the range of from 50 to 500 g/l, preferably 200 to 350 g/l.

SUMMARY OF INVENTION

The present inventors have surprisingly found that a speckle composition with a layering system can deliver photobleach to the fabric with little or no staining.

In a first aspect, the present invention provides a granular composition for use as speckles in a particulate laundry detergent composition comprising a porous granular carrier, at least 0.01 wt % photobleach based on the active ingredient, the composition being layered with a finely divided high carrying capacity particulate material and/or a water-soluble material.

In a second aspect, the present invention provides a particulate laundry detergent composition which comprises surfactant, optionally builder, and from 0.05 to 10 wt % of speckles which are a granular composition as defined above.

In a third aspect, the present invention provides a process for making a granular composition for use as speckles in a particulate laundry detergent composition, which comprises the steps of:

(i) mixing a liquid photobleach with a porous carrier; followed by (ii) layering with a finely divided, high liquid carrying capacity particulate material and/or a water-soluble material.

In a fourth aspect, the present invention provides the use of a granular composition layered with a finely divided high carrying capacity particulate material and/or a water-soluble material as speckles in a particulate laundry detergent composition.

DETAILED DESCRIPTION

The Speckles

The granular compositions of the present invention are intended to be used as speckles in particulate laundry detergent compositions. It is important that such speckles comprise at least 0.01 wt % of the photobleach active ingredient. It is also believed that reduced staining can be achieved if the photobleach is locked into the carrier by at least one coating layer. The composition is layered with a finely divided high carrying capacity particulate material and/or a water-soluble material. Preferably the water-soluble material is a water-soluble polymer. Preferably the composition is layered with both a water-soluble material and a finely divided high carrying capacity particulate material. For an even greater effect the composition contains at least two layers of each material.

The finely divided high liquid carrying capacity particulate material preferably has a dibutyl phthalate carrying capacity of at least 40 ml/100 g, preferably at least 50 ml/100 g and even more preferably at least 60 ml/100 g. In order that the speckles may provide effective delivery of photobleach for the whole of the detergent powder for which they are intended to be incorporated it is preferred that they comprise at least 0.05 wt % photobleach based on the active ingredient, preferably at least 0.1 wt %.

The carrier for the speckles is preferably light sodium carbonate (light soda ash). Light sodium carbonate may be distinguished from other grades of particulate sodium carbonate primarily by bulk density and has a bulk density of from 500 to 700 g/l. The carrier for use in the present invention preferably has a bulk density of less than 800 g/l, more preferably less than 700 g/l, most preferably less than 600 g/l.

Although the carrier for the photobleach is of a relatively low density, the resultant granule for use as a speckle may have an increased bulk density due to its processing and still perform effectively as a delivery vehicle for the photobleach. Therefore, in one embodiment of the invention the granular composition has a bulk density of greater than 500 g/l, preferably greater than 600 g/l, more preferably greater than 700 g/l, or even greater than 800 g/l.

Preferred photobleaches are phthalocyanine sulphonates, especially zinc phthalocyanine sulphonates, aluminium phthalocyanine sulphonates or a mixture of the two.

It is unnecessary to include ingredients which may cause effervescence, and hence it is preferred that the speckle is non-effervescent. However, inclusion of effervescence-generating ingredients is within the scope of the invention.

In a preferred embodiment the granular composition for use as speckles has a number average particle size of less than 400 microns, preferably less than 300 microns. This can improve the solubility and thereby decrease staining tendencies still further.

The Process for Making the Speckles

The process of manufacture of the speckles according to the present invention comprises the steps of:

(i) mixing a liquid photobleach with a porous granular carrier; followed by (ii) layering with a finely divided, high liquid carrying capacity particulate material and/or a water-soluble material.

Preferred high liquid carrying capacity particulate materials are zeolite and/or silica.

Preferably step (ii) comprises layering with both a finely divided, high liquid carrying capacity particulate material and a water-soluble material.

It is preferred that the process is followed by a third step involving further layering with a finely divided, high liquid carrying capacity particulate material and/or a water-soluble material, preferably both together.

In any or all of the process steps the water-soluble material is preferably a water-soluble polymer.

A particularly advantageous process is wherein step (i) comprises atomising and spraying the liquid photobleach onto the carrier.

The Particulate Laundry Detergent Composition

Detergent compositions of the present invention comprise surfactant and optionally builder. They also contain from 0.05 to 10 wt %, preferably from 1 to 5 wt %, of speckles as described above. It is preferred that the compositions comprise from 5 to 60 wt % surfactant and from 10 to 80 wt % builder.

In a particularly advantageous embodiment the whole composition is coloured blue, however the speckles contained within it are a darker shade of blue than the rest of the composition. In another particularly advantageous embodiment the bulk of the powder is coloured white and the speckles are coloured blue.

Photobleach may be present in both the speckles and the composition as a whole, and preferably at least 50 wt % of the total photobleach present is within the speckles. It is most preferred that the photobleach is entirely contained within the speckles.

Detergent Ingredients

The particulate laundry detergent compositions of the present invention will also contain conventional detergent ingredients, notably detergent-active materials (surfactants), and preferably also detergency builders.

Such detergent compositions will contain one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds. Non-soap anionic surfactants are especially preferred.

Non-soap anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred. A preferred anionic surfactant is linear alkylbenzene sulphonate.

Nonionic surfactants may optionally be present. These include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants may optionally be present. These include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$–$C_{22}$ alkyl group, preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups); and cationic esters (for example, choline esters).

In an especially preferred cationic surfactant of the general formula $R_1R_2R_3R_4N^+X^-$, $R_1$ represents a $C_8$–$C_{10}$ or $C_{12}$–$C_{14}$ alkyl group, $R_2$ and $R_3$ represent methyl groups, $R_4$ presents a hydroxyethyl group, and X represents a halide or methosulphate ion.

Optionally, amphoteric surfactants, for example, amine oxides, and zwitterionic surfactants, for example, betaines, may also be present.

Preferably, the quantity of anionic surfactant is in the range of from 5 to 50% by weight of the total composition. More preferably, the quantity of anionic surfactant is in the range of from 8 to 35 wt %, most preferably from 10 to 30 wt %.

Nonionic surfactant, if present, is preferably used in an amount within the range of from 1 to 20 wt % in addition to that which may be present in the structured emulsion.

The detergent compositions may contain as builder a crystalline aluminosilicate, preferably an alkali metal aluminosilicate, more preferably a sodium aluminosilicate (zeolite).

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Most preferably, the builder is selected from sodium tripolyphosphate, zeolite, sodium carbonate, and combinations thereof.

Organic builders may optionally be present. These include polycarboxylate polymers such as polyacrylates and acrylic/maleic copolymers; polyaspartates; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyl iminodiacetates, alkyl- and alkenylmalonates and succinates; and sulphonated fatty acid salts.

Organic builders may be used in minor amounts as supplements to inorganic builders such as phosphates and zeolites.

Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system, although non-bleaching formulations are also within the scope of the invention.

The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA) and the polyphosphonates such as Dequest (Trade Mark), EDTMP.

The detergent compositions may also contain one or more enzymes. Suitable enzymes include the proteases, amylases, cellulases, oxidases, peroxidases and lipases usable for incorporation in detergent compositions.

Preferred proteolytic enzymes (proteases) are catalytically active protein materials which degrade or alter protein types of stains when present as in fabric stains in a hydrolysis reaction. They may be of any suitable origin, such as vegetable, animal, bacterial or yeast origin. Proteolytic enzymes or proteases of various qualities and origins and having activity in various pH ranges of from 4–12 are available. Proteases of both high and low isoelectric point are suitable.

Other enzymes that may suitably be present include lipases, amylases, and cellulases including high-activity cellulases such as Carezyme (Trade Mark) ex Novo.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example, cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22.

Especially preferred soil release polymers are the sulphonated non-end-capped polyesters as described and claimed in WO 95 32997A (Rhodia Chimie).

The detergent compositions may also include one or more inorganic salts other than builder salts. These may include, for example, sodium bicarbonate, sodium silicate, sodium sulphate, magnesium sulphate, calcium sulphate, calcium chloride and sodium chloride. Preferred inorganic salts are sodium sulphate, sodium chloride, and combinations thereof.

The detergent compositions may also contain other inorganic materials, for example, calcite, silica or amorphous aluminosilicate, or clays.

Other ingredients that may be present include solvents, hydrotropes, fluorescers, dyes, foam boosters or foam controllers (antifoams) as appropriate, fabric conditioning compounds and perfumes.

Preparation of the Detergent Composition

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes. In both types of powder, the speckle composition may be incorporated by postdosing (dry mixing).

The composition of the invention may alternatively be in tablet form. Tablets may be prepared by compacting powders, especially "concentrated" or "compact" powders, prepared as described above. Additionally, the composition may be in the form of a liquid, gel, paste or extrudate.

EXAMPLES

Examples 1 and 2

Photobleach Speckles

Speckle compositions were prepared to the following formulation:

| Ingredient | Wt % |
|---|---|
| Light sodium carbonate | 68.75 |
| Photobleach (as 10% active) | 1.25 |
| 2 wt % hydroxyethyl cellulose polymer solution | 10.0 |
| Zeolite layering | 5.0 |
| Water | 15.0 |

In Example 1, the photobleach used was a mixture of zinc and aluminium phthalocyanine sulphonate.

In Example 2, the photobleach used was an aluminium phthalocyanine sulphonate.

Both photobleaches were obtained from Ciba-Geigy under the "Tinolux" Trade Mark.

It will be seen that both compositions contained 0.125 wt % photobleach calculated as 100% active.

Each composition was prepared as follows.

The 10% photobleach solution together with the water was sprayed onto the sodium carbonate and gently mechanically agitated for 10 minutes to ensure good mixing. Half of the polymer solution was then sprayed on, followed by half of the layering zeolite. The blend was then gently mixed for a further 10 minutes. The remaining polymer solution was then sprayed on and the remaining layering zeolite was added. This was again followed by 10 minutes of gentle mixing. The resultant speckle composition had a bulk density of around 850 g/l and a number average particle size of around 200 microns.

Examples 3 and 4 and Comparative Examples A to D

Photobleach Staining

The spray-dried detergent compositions tested for staining had the following formulation:

TABLE 2

| Ingredient | wt % of base powder | wt % of total |
|---|---|---|
| Spray Dried Base | | |
| NaLAS | 25.74 | 18.13 |
| Sodium silicate | 11.40 | 8.03 |
| Sodium tripolyphosphate | 17.21 | 12.12 |
| Sodium carboxymethylcellulose | 0.72 | 0.51 |
| Sodium sulphate | 35.32 | 24.88 |
| Fluorescer | 0.25 | 0.18 |
| Antifoam granule | 0.027 | 0.019 |
| Blue colourant | 0.021 | 0.015 |
| Water | 9.31 | 6.56 |
| Sub Total | 100.0 | 70.44 |
| Post-Dosed | | |
| Sodium sulphate | | 9.57 |
| Sodium carbonate | | 15.0 |
| Dequest 2047 (sequestrant) | | 0.40 |
| Enzymes | | 0.24 |
| Sodium perborate | | 3.35 |
| TAED | | 1.0 |
| Total | | 100.0 |

Photobleach speckles were added to this detergent base to make compositions either inside or outside the present invention.

Example 3 contained 2 wt % of a speckle composition according to Example 1 where the photobleach was a mixture of zinc and aluminium phthalocyanine sulphonate.

Example 4 contained 2 wt % of a speckle composition according to Example 2 where the photobleach was aluminium phthalocyanine sulphonate.

Comparative Example A contained 2 wt % of an aluminium phthalocyanine sulphonate photobleach speckle of the same concentration as in Example 1 but with dense soda ash as a carrier.

Comparative Example B contained 2 wt % of an aluminium phthalocyanine sulphonate photobleach speckle of the same concentration as in Example 1 but with clay as a carrier.

Comparative Example C contained 2 wt % of a mixture of zinc and aluminium phthalocyanine sulphonate photobleach speckle of the same concentration as in Example 1 but with clay as a carrier.

Comparative Example D contained no photobleach speckle.

Experimental Protocol

Six pieces of white knitted cotton of size 15 cm×15 cm were used as test cloths. The cloths were placed at the bottom of a bowl containing 1 litre of water, onto which 10 g of the detergent composition was poured. The detergent composition was allowed to settle for 10 minutes, after which the fabric was removed and gently rinsed to remove any detergent residues. The fabrics were subsequently dried in a tumble drier and then assessed for the degree of staining, by an expert panel, on a scale of 1 to 5. A result of 1 means no staining and a result of 5 means full staining. A summary of the experimental conditions and the staining results are shown in table 3.

TABLE 3

| Experiment | Photobleach | Carrier | Bulk Density g/l | Degree of staining |
|---|---|---|---|---|
| 3 | Zn/Al | As in Example 1 | 850 | 1–2 |
| 4 | Al | As in Example 2 | 850 | 1–2 |
| A | Al | Dense soda ash | 1100 | 3 |
| B | Al | Clay | 935 | 5 |
| C | Zn/Al | Clay | 935 | 4 |
| D | — | — | — | 1 |

Examples 5 to 8

Detergent Compositions

The formulations shown in Table 2 represent detergent compositions in accordance with the invention.

TABLE 2

| Ingredient | wt % | | | |
|---|---|---|---|---|
| | 5 | 6 | 7 | 8 |
| Spray Dried Base | | | | |
| Sodium LAS | 17.73 | 6.59 | 19.5 | 12.3 |
| Nonionic surfactant($C_{12-13}$ 6–7 EO) | — | 3.27 | — | 2.9 |
| Sodium soap | 0.78 | 2.39 | — | — |
| Sodium tripolyphosphate | 21.4 | 24.1 | 31.7 | 34.4 |
| Sodium silicate | 7.34 | 6.79 | 5.63 | 6.58 |
| Sodium carboxymethylcellulose | 0.33 | 0.49 | 0.20 | 0.47 |
| Fluorescer | 0.10 | 0.13 | 0.11 | 0.14 |
| Sodium sulphate | 22.6 | 25.8 | 12.3 | 0.61 |
| Sodium chloride | — | — | — | 1.83 |
| Silicone antifoam | — | — | 0.03 | 0.05 |
| Water | 12.8 | 9.8 | 12.1 | 16.0 |
| Post Dosed | | | | |
| Sodium carbonate | 14.2 | 16.7 | 12.7 | 15.33 |
| Enzymes | 0.45 | 0.58 | 0.24 | 0.68 |
| Perfume | 0.28 | 0.33 | 0.27 | 0.31 |
| Antifoam granule | — | 1.0 | — | 3.0 |
| Sodium perborate | — | — | 2.38 | 2.5 |
| TAED | — | — | 0.86 | 0.90 |
| Photobleach speckles of Example 1 | 2.00 | 2.00 | 2.00 | 2.00 |

We claim:

1. A granular composition for use as speckles in a particulate laundry detergent composition comprising a porous granular carrier, at least 0.01 wt % photobleach based on the active ingredient, the composition being layered with a finely divided high carrying capacity particulate material and/or a water-soluble material.

2. A granular composition as claimed in claim 1, which has a bulk density of greater than 500 g/l, preferably greater than 600 g/l, more preferably greater than 700 g/l.

3. A granular composition as claimed in claim 1, wherein the water-soluble material is a water-soluble polymer.

4. A granular composition as claimed in claim 1, wherein the composition is layered with both a water-soluble material and a finely divided high carrying capacity particulate material.

5. A granular composition as claimed in claim 4, which contains at least two layers of each material.

6. A granular composition as claimed in claim 1, wherein the porous carrier is light sodium carbonate with a bulk density in isolated of from 500 to 700 g/l.

7. A granular composition as claimed in claim 1, which comprises at least 0.05 wt % photobleach based on the active ingredient.

8. A granular composition as claimed in claim 7, which comprises at least 0.1 wt % photobleach.

9. A granular composition as claimed in claim 1, wherein the photobleach is a zinc and/or aluminium phthalocyanine sulphonate.

10. A granular composition as claimed in claim 9, wherein the photobleach is a mixture of zinc and aluminium phthalocyanine sulphonate.

11. A granular composition as claimed in claim 1, which is non-effervescent.

12. A granular composition as claimed in claim 1, which has a number average particle size of less than 400 microns, preferably less than 300 microns.

13. A particulate laundry detergent composition which comprises surfactant, optionally builder, and from 0.05 to 10 wt % of speckles which are a granular composition according to claim 1.

14. A detergent composition as claimed in claim 13, which comprises from 1 to 5 wt % of speckles.

15. A detergent composition as claimed in claim 13, which comprises from 5 to 60 wt % surfactant and from 10 to 80 wt % builder.

16. A detergent composition as claimed in claim 13, wherein the bulk of the composition is blue and the speckles are a darker shade of blue than the rest of the composition.

17. A detergent composition as claimed in claim 13, wherein the bulk of the composition is white and the speckles are blue.

18. A detergent composition as claimed in claim 13, wherein at least 50 wt % of photobleach present in the composition is contained within the speckles.

19. A detergent composition as claimed in claim 18, wherein all photobleach in the composition is contained within the speckles.

20. A process for making a granular composition for use as speckles in a particulate laundry detergent composition, which comprises the steps of:

(i) mixing a liquid photobleach with a porous granular carrier; followed by (ii) layering with a finely divided, high liquid carrying capacity particulate material and/or a water-soluble material.

21. A process as claimed in claim 20, wherein step (ii) comprises layering with both a finely divided, high liquid carrying capacity particulate material and a water-soluble material.

22. A process as claimed in claim 20, which is followed by at least one more layering step involving layering with a finely divided, high liquid carrying capacity particulate material and/or a water-soluble material, preferably both together.

23. A process as claimed in claim 20, wherein the water-soluble material is a water-soluble polymer.

24. A process as claimed in claim 20, wherein the high liquid carrying capacity material is zeolite and/or silica.

25. A process as claimed in claim 20, wherein step (i) comprises atomising and spraying the liquid photobleach onto the light sodium carbonate.

* * * * *